US012656080B2

(12) United States Patent
Carney et al.

(10) Patent No.: US 12,656,080 B2
(45) Date of Patent: Jun. 16, 2026

(54) MODULAR HANDGUARD SYSTEM FOR AK-TYPE RIFLES

(71) Applicant: Centre Firearms Co., Inc., Ridgewood, NY (US)

(72) Inventors: Sean Carney, Ridgewood, NY (US); Ryan Watts, Ridgewood, NY (US); Greg Hayes, Ridgewood, NY (US); Danniel Day, Ridgewood, NY (US)

(73) Assignee: Centre Firearms Co., Inc., Ridgewood, NY (US)

( * ) Notice: Subject to any disclaimer, the term of this patent is extended or adjusted under 35 U.S.C. 154(b) by 0 days.

(21) Appl. No.: 18/745,389

(22) Filed: Jun. 17, 2024

(65) Prior Publication Data

US 2025/0383175 A1 Dec. 18, 2025

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41G 11/003
See application file for complete search history.

(56) References Cited

U.S. PATENT DOCUMENTS

| | | | | |
|---|---|---|---|---|
| 12,104,872 | B1 * | 10/2024 | Bray | F41C 23/16 |
| 2012/0198990 | A1 * | 8/2012 | Brittin | F41A 5/26 89/191.01 |
| 2014/0331538 | A1 * | 11/2014 | Spiegelhauer | F41C 23/16 42/71.01 |
| 2017/0176135 | A1 * | 6/2017 | Fesas | F41C 23/16 |
| 2019/0162505 | A1 * | 5/2019 | Mezynski | F41C 27/00 |
| 2023/0160658 | A1 * | 5/2023 | Lee | F41C 23/16 42/71.01 |
| 2025/0224199 | A1 * | 7/2025 | Wisbith | F41C 23/16 |
| 2025/0237445 | A1 * | 7/2025 | Bray | F41A 3/66 |

* cited by examiner

*Primary Examiner* — Jonathan C Weber
(74) *Attorney, Agent, or Firm* — Duane Morris LLP

(57) ABSTRACT

A handguard system for a firearm includes a lower handguard attached to the firearm by first mount providing an extension force between the lower handguard and a receiver of the firearm; and an upper handguard attached to the lower handguard.

12 Claims, 15 Drawing Sheets

MODULAR HANDGUARD SYSTEM FOR AK-TYPE RIFLES

BACKGROUND

The present disclosure relates to a handguard system for a rifle. More specifically, the present disclosure relates to a modular handguard system for AK-type rifles.

Shown in FIG. 1, the AK-47 100 is a select-fire, 7.62×39 mm, air-cooled, long-stroke-piston gas-operated, magazine-fed rifle, with a rotating bolt. It was designed to be a simple, reliable automatic rifle that could be manufactured quickly and cheaply, using mass production methods that were state of the art in the Soviet Union during the late 1940s. Developed in the Soviet Union by Russian small-arms designer Mikhail Kalashnikov, it is the originating firearm of the Kalashnikov (or "AK") family or type of rifles. After more than eight decades since its creation, the AK-47 model and its variants remain one of the most popular and widely used firearms in the world. The AK-47 100 design was finalized, adopted, and entered widespread service in the Soviet Army in the early 1950s. Its firepower, ease of use, low production costs, and reliability were perfectly suited for the Soviet Army's new mobile warfare doctrines. More AK-type firearms have been produced than all other assault rifles combined. In 1974, the Soviets began replacing their AK-47 100 and AKM rifles with a newer design, the AK-74, which uses 5.45×39 mm ammunition.

The model and its variants owe their global popularity to their reliability under harsh conditions, low production cost (compared to contemporary weapons), availability in virtually every geographic region, and ease of use. The AK has been manufactured in many countries and has seen service with armed forces as well as irregular forces and insurgencies throughout the world. The model is the basis for the development of many other AK-types of individual, crew-served, and specialized firearms.

The gas block 110 of the AK-47 100 features a cleaning rod capture and/or sling loop. Gas relief ports that alleviate gas pressure are placed horizontally in a row on the gas tube 115. The AK-47 100 uses a notched rear tangent iron sight 120 calibrated in 100 m increments from 100 to 800 m. The standard magazine 130 capacity is 30 rounds.

The AK-47 110 original equipment for upper and lower forearms 160/150 are made from wood or polymer with aluminum heat shielding. These designs trap heat and provide very little airflow for cooling the barrel 170, and the piston operating system 110 during prolonged periods of high cyclic rate shooting and are prone to catch fire and or melt. Furthermore, these upper and lower forearms 160/150 provide no mounting points for view through optics, image intensifiers, illumination devices, active aiming systems and other weapon accessories. These accessories require a standardized stable mounting interface to maintain consistent alignment to the AK-47 100 weapon barrel 170, while mitigating heat conduction from both the barrel 170 and piston operating system 110 into the accessories.

SUMMARY OF THE DISCLOSURE

To overcome the problems described above, the AK modular handguard system of the present disclosure is designed to facilitate easy separation of the upper handguard/gas tube for firearm servicing while preserving bore-sight aligning of mounted optics. The disclosed modular handguard system for an AK-type rifle platform utilizes a unique pin and wedge joining system to attach the upper and lower handguards which can be interchanged with different lengths of each to provide efficient firearm mounting space for a variety of optics, electro-optics, and accessories configurations. The interface between the 2-piece handguard provides a rigid system that locks together in all three directional planes to minimize any alignment shift of mounted devices when the two upper and lower halves are separated and then rejoined. This reduces/eliminates the need to realign mounted devices after servicing the AK's gas piston system during cleaning. Accessories are mounted to the handguard utilizing optional M-LOK® and MIL-STD-1913 (Picatinny) rail mounting interface systems to minimize the handguard profile, support hand comfort, and provide rigid attachment points for primary optics. Attachment of the lower handguard utilizes existing AK lower handguard attachment points without modification of the base firearm system and eliminates additional paths for heat transfer from the barrel into the disclosed modular handguard system.

In addition to including a rail system with repeatable alignment upon assembly, the disclosed modular handguard system provides the benefits of making the gas system easily accessible for maintenance.

To expand the capabilities of the base firearm, embodiments of the present disclosure provide a modular handguard that assembles in a rigid manner while providing a MIL-STD-1913 rail interface and commercial standard M-LOK® interface slots for attaching accessories.

Additionally, embodiments of the present disclosure provide the ability to configure the handguard to allow for additional optics mounting locations behind the AK-47 rear sight.

Additionally, embodiments of the present disclosure require no modifications to the base firearm.

According to an embodiment, a device to attach a handguard to a firearm includes a lower handguard including an extension; and a wedge block configured to provide an extension force to force the extension into an internal surface of a receiver of the firearm as the wedge block and the lower handguard are forced together, wherein the extension force attaches the handguard to the firearm.

The device can further include a spring attached to the wedge block and configured such that the spring provides a spring force to a trunnion of the firearm as the wedge block and the lower handguard are forced together.

In an aspect, the extension is two opposing extensions that are configured to fit inside the receiver and the extension force forces the two opposing extensions into opposing internal surfaces of the receiver.

The device can further include a retention mount configured to fit in a groove of the lower handguard; and a U-mount configured fit with the lower handguard and to attach to a handguard retainer of the firearm and provide a rearward force of the lower handguard between the handguard retainer and the receiver via the retention mount.

In an aspect, the lower handguard includes a rail.

The device can further include an upper handguard attached to the lower handguard.

In another embodiment, a method of attaching a handguard to a firearm includes providing an extension force to force an extension of a lower handguard into an internal surface of a receiver of the firearm.

In an aspect, the extension is two opposing extensions that are configured to fit inside the receiver and the extension force forces the two opposing extensions into opposing internal surfaces of the receiver.

In an aspect, the extension force is provided by a wedge force that forces a wedge block between the two opposing extensions.

In an aspect, the wedge force is provided by forcing the wedge block and the lower handguard together.

The method can further include providing a spring force between a spring attached to the lower handguard and a trunnion of the firearm.

In an aspect, the spring is a leaf spring directly coupled to a wedge block.

The method can further include providing a rearward force between a handguard retainer of the firearm and the lower handguard.

The method can further include attaching a mount to the handguard retainer and the lower handguard, wherein the rearward force is provided between the mount and the lower handguard.

In another embodiment, a handguard system for a firearm includes a lower handguard attached to the firearm by first mount providing an extension force between the lower handguard and a receiver of the firearm; and an upper handguard attached to the lower handguard.

The handguard system can further include a wedge block of the first mount configured to provide the extension force between extensions of the lower handguard and the receiver.

The handguard system can further include a second mount configured to provide a rearward force to the lower handguard between a handguard retainer of the firearm and the receiver.

In an aspect, the lower handguard and the upper handguard include a rail.

In an aspect, the upper handguard is configured to extend rearward of and not interfere with a rear sight of the firearm.

In an aspect, the upper handguard and the lower handguard are not in direct physical contact to a barrel or a gas tube of the firearm.

In an aspect, an aiming device attached to the upper handguard maintains alignment to the weapon bore within 1.5 MOA when the upper handguard is removed from the lower handguard and reinstalled to the lower handguard.

A firearm can include the device or the handguard system.

The above and other features, elements, characteristics, steps, and advantages of the present invention will become more apparent from the following detailed description of preferred embodiments of the present invention with reference to the attached drawings.

DETAILED DESCRIPTION

Figure 1:
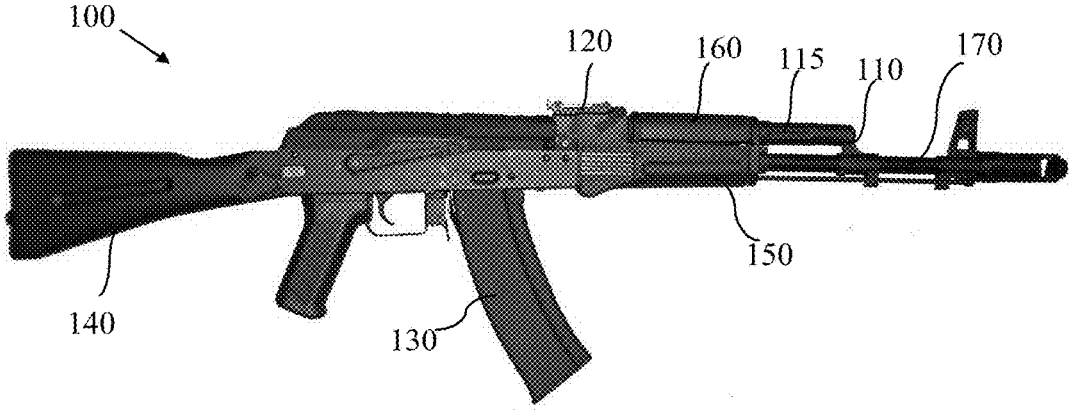
FIG. 1 shows a conventional AK-47 rifle.

Reference will now be made in detail to embodiments of the present disclosure, examples of which are illustrated in the accompanying drawings. Whenever possible, the same reference numerals will be used throughout the drawings to refer to the same or like parts. However, this disclosure may be embodied in many different forms and should not be construed as limited to the embodiments set forth herein.

Directional terms as used herein—for example up, down, right, left, front, back, top, bottom, vertical, horizontal—are made only with reference to the features as drawn and are not intended to imply absolute orientation.

As used herein, the singular forms "a," "an," and "the" include plural references unless the context clearly dictates otherwise. Thus, for example, reference to "a" component includes aspects having two or more such components, unless the context clearly indicates otherwise.

In the following description, reference is made to the accompanying drawings that form a part thereof, and in which is shown by way of illustrating specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense.

Embodiments of the present disclosure integrate a rail system with a modular handguard to be used with a firearm. As described below, embodiments of the modular handguard system of the present disclosure provide a rigid platform for the rail system to attach various accessories in a repeatable manner. Although described with respect to AK-type rifles, the disclosed embodiments can be adapted to firearms that requires the handguard to fit over any components such as the sights, barrel, gas tube, cocking tube, or charging handle.

In contrast to other known handguards, modular handguards of disclosed embodiments require minimal fasteners to attach to the base firearm. The disclosed modular handguard system also has no additional barrel or gas tube contact as in other known handguards, which could affect accuracy. This lack of contact between the modular handguard and the barrel further reduces heat transfer into the disclosed handguards.

Figure 2:
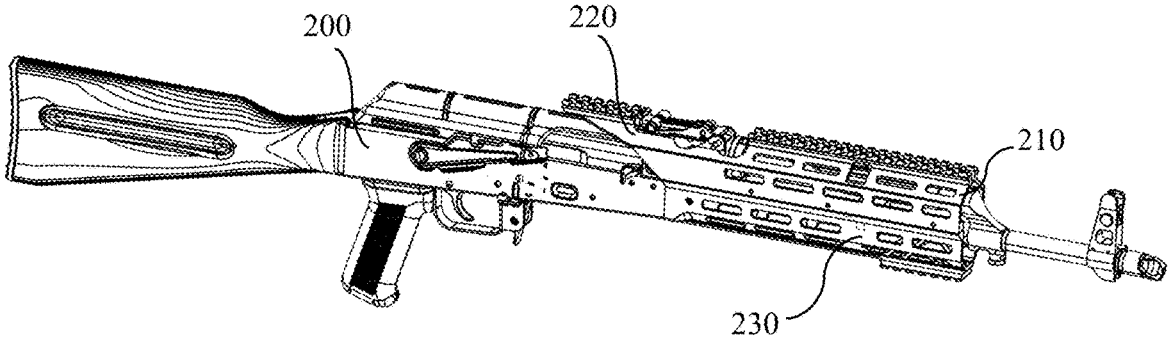
FIG. 2 shows a conventional AK-47 rifle including a modular handguard system according to an embodiment.

FIG. 2 shows a AK modular handguard 210 mounted on a AK-type rifle 200 (i.e., the base firearm), according to an embodiment of the present disclosure. The disclosed modular handguard system has been developed to expand capabilities of the base firearm 200 by reconfiguring some components. In this case, both the M-LOK® and MIL-STD-1913 rail systems have been incorporated into the handguard, and other rail systems are possible. This provides flexibility to add and/or remove various accessories such as optics, grips, bipods, lights, lasers, and the like to the base firearm 200 in a repeatable manner.

In order to reliably and repeatably mount accessories onto the rail system, the modular handguard 210 is rigidly attached to the base firearm 200 as any shift in position can affect the ability of the accessories to work as intended. This is especially true for aiming devices such as optics and lasers. Additionally, any other accessories that affect how the firearm is held or supported are affected by any shift in position.

The modular handguard 210 differs from an original handguard in that the upper handguard 220 and lower handguard 230 are connected. The rear or proximal end of the modular handguard 210 is attached to the front end of the receiver of the AK-type rifle 200. This attachment is achieved with wedge geometry in an assembly acting on the receiver and the trunnion of the firearm. At the front or distal end, a U-shaped clamp insert can connect the modular handguard 210 to the existing AK handguard retainer originally connected to the AK forward lower handguard mount. These attachments require no modification to the base firearm 200 and provides a rigid platform for mounting accessories. Additionally, unlike other aftermarket handguard systems, no modification to (i.e. file to fit) or selection of alternative parts is required to mount the modular handguard 210.

Figure 3:
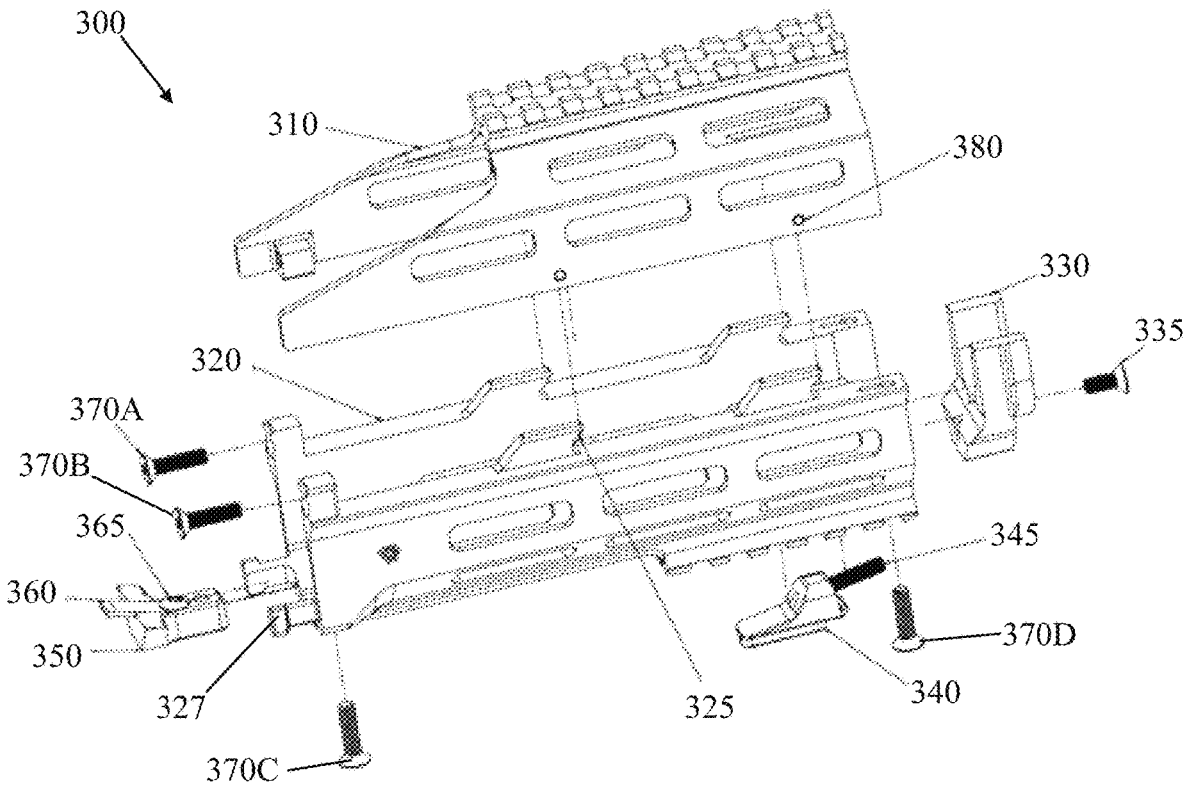
FIG. 3 is an exploded view of a modular handguard system according to an embodiment.

An exploded view of an exemplary modular handguard system 300 is shown in FIG. 3. As shown, the modular handguard system 300 can include an upper handguard 310, a lower handguard 320, a U-mount 330, a retention mount 340, a wedge block 350, and a leaf spring 360. Several fasteners can be included such as a leaf spring screw 365, attachment screws 370A-370D, pins 380 (e.g. 4 places) to fit into corresponding wedge alignment features 325, a locking screw 345, and a retaining screw 335. The pins 380 can be press fit into holes in the upper handguard 310 and further secured into place with a locking compound.

Figure 4:
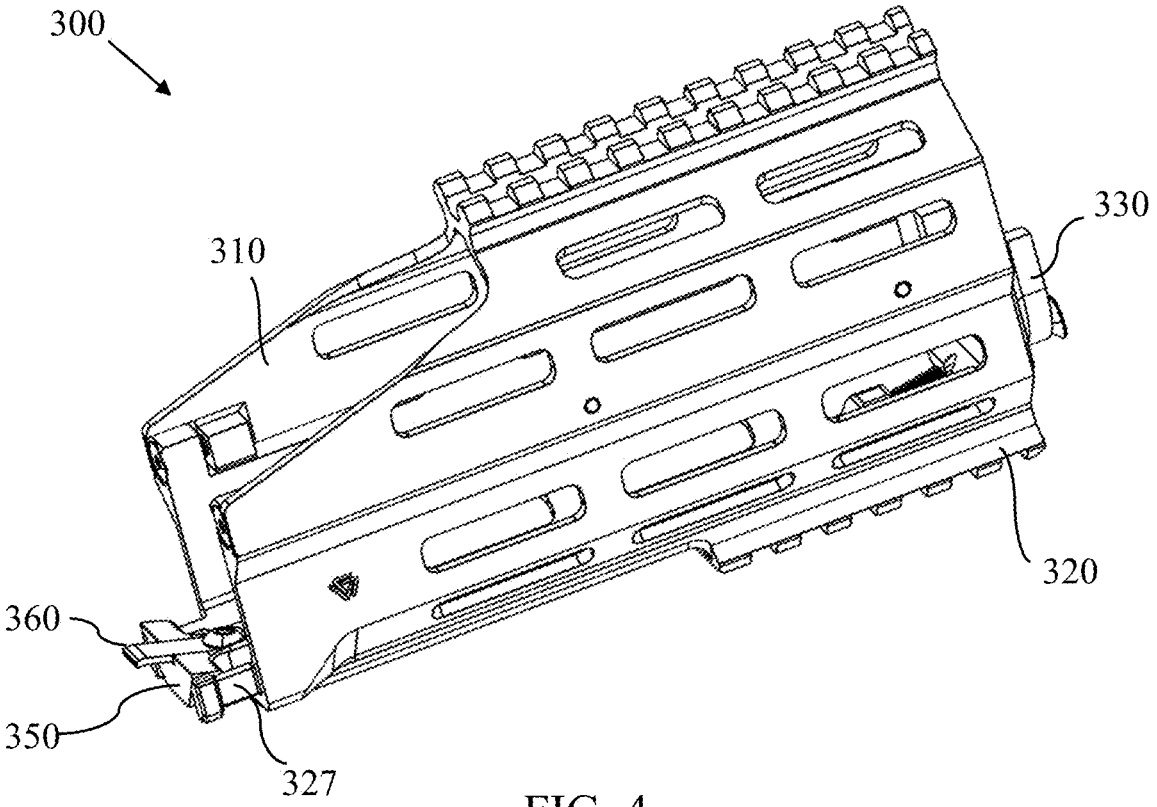
FIG. 4, FIG. 5, and FIG. 6 are perspective views of a modular handguard system without a rifle.
Figure 5:
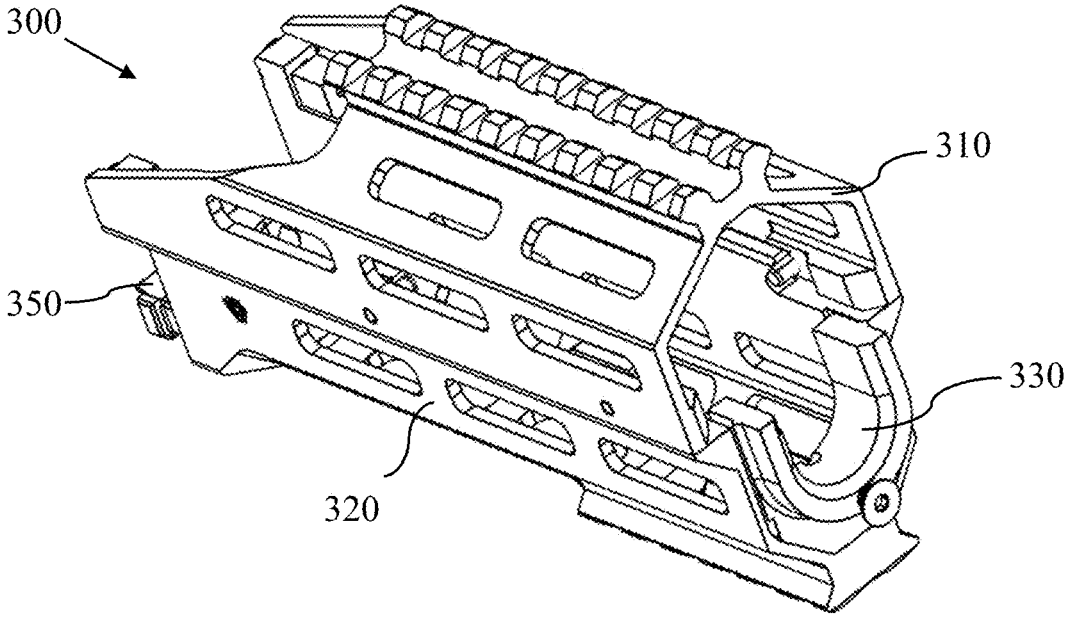
Figure 6:
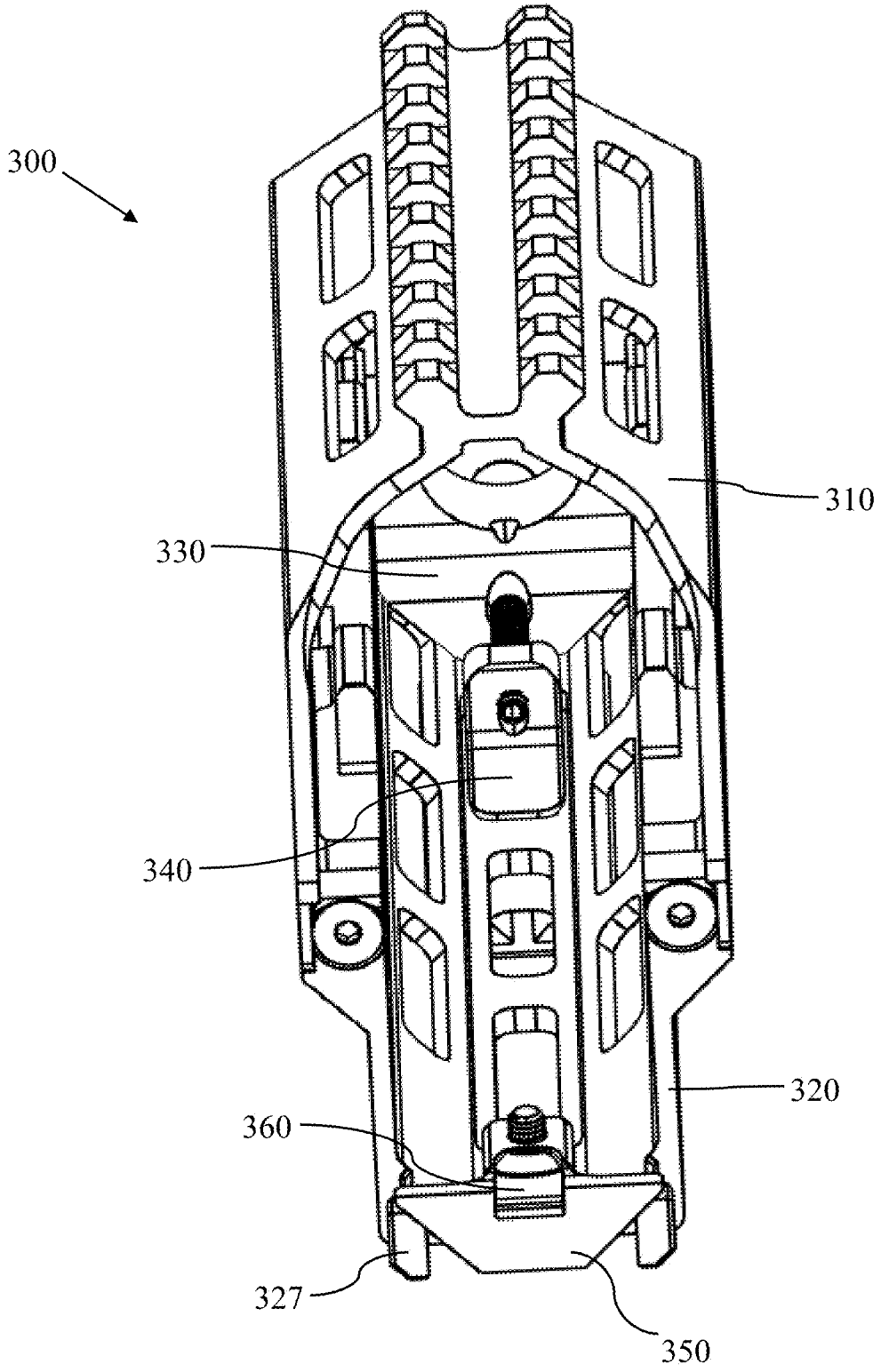
Figure 7:
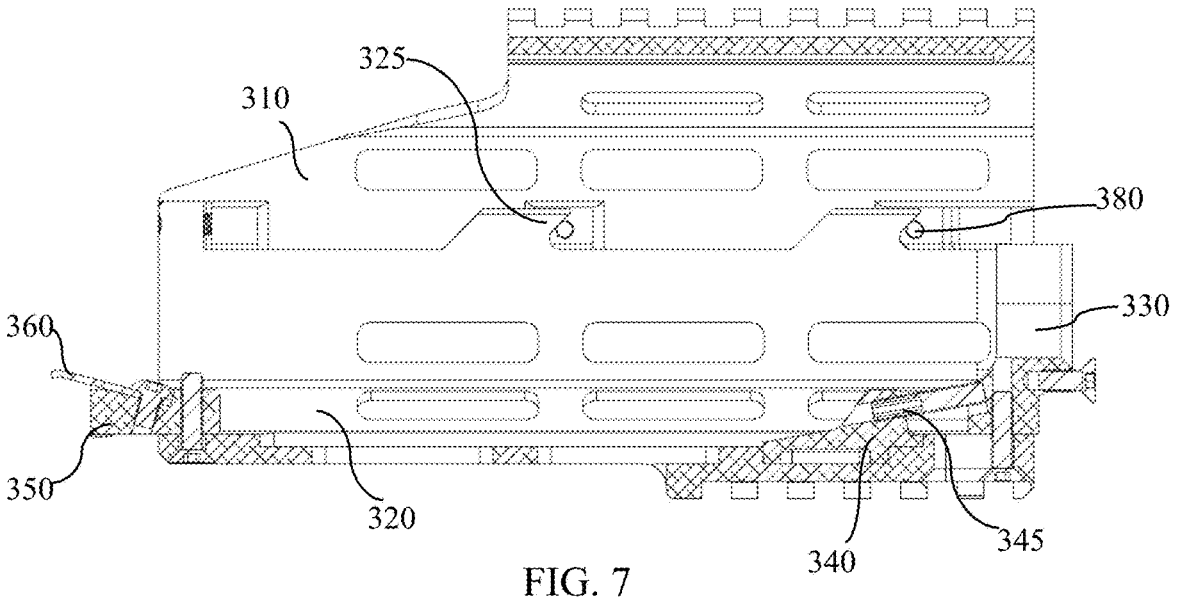
FIG. 7, FIG. 8, and FIG. 9 are cross sectional view of a modular handguard system.
Figure 8:
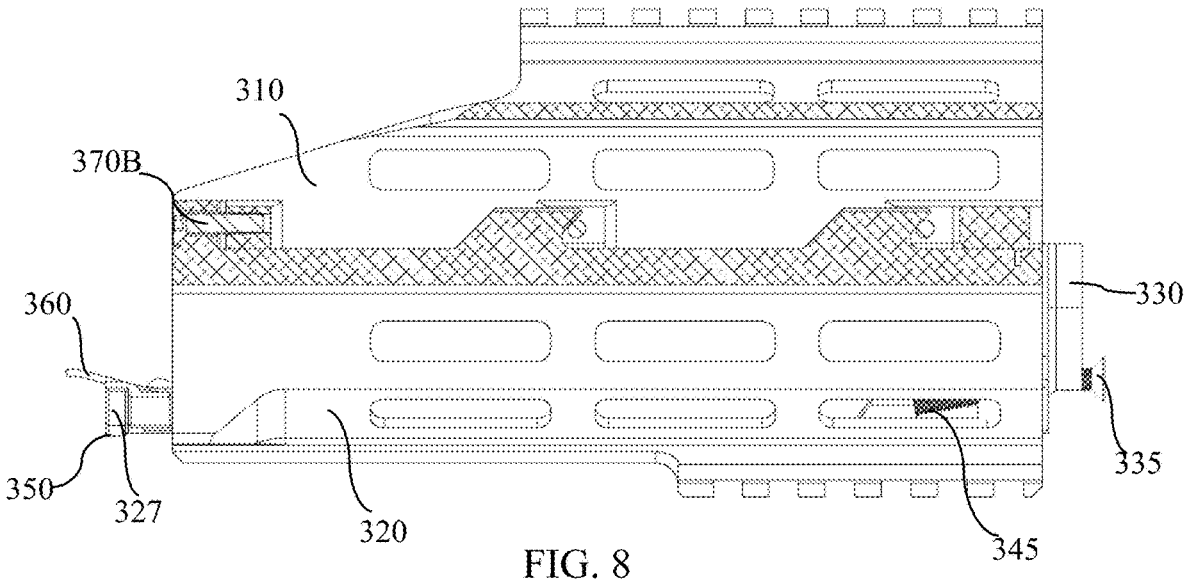
Figure 9:
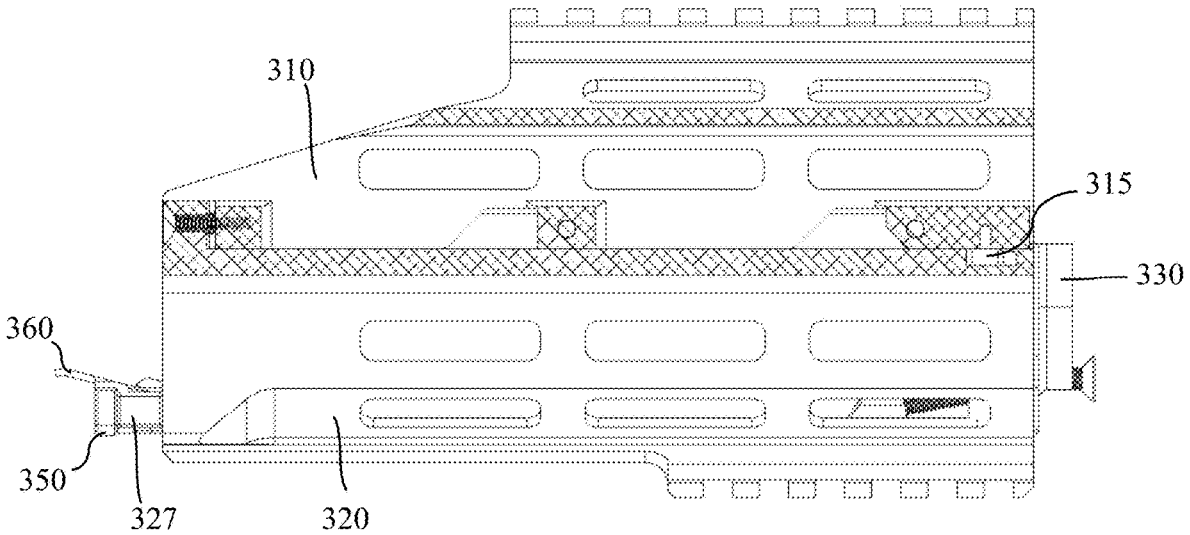

FIGS. 4-6 are different unexploded perspective views of the modular handguard system 300 and FIGS. 7-9 are sectional views showing the geometry and relationships of the components together with a firearm omitted from the figures for clarity.

The lower handguard 320 is secured to the base firearm via rear and front attachment assemblies as described in greater detail below. The pin 380 and wedge 325 interface allows the upper handguard 310 to be securely attached to the lower handguard 320. The two attachment screws 370A and 370B draw the upper handguard 310 rearward. When the pins 380 encounter the angled or incline geometry of the wedge 325 the upper handguard 310 is driven down on to the top surface of the lower handguard 320 creating a solid vertical contact. The side of each wedge 325 is also in close contact with a surface of a boss of the corresponding pin 380 which limits the side-to-side movement of the handguards. Additionally, as shown in FIG. 9, there are also limit pins 315, one on each side of the upper handguard 310, that extend from a hole in the upper handguard 310 to a corresponding slot in the lower handguard 320 to further limit any lateral movement between the upper and lower handguards. In some embodiments, the limit pins 315 can be replaced with protruding tabs integral with and extending from the upper handguard 310 that fit into the corresponding slots in a lower handguard 320. The attachment screws 370A-B additionally restrict any relative movement between the upper and lower handguards. This permits aiming devices that are mounted on the upper handguard 310 to maintain a return to zero within 1.5 MOA when the upper handguard 310 is removed and reinstalled.

Figure 10:
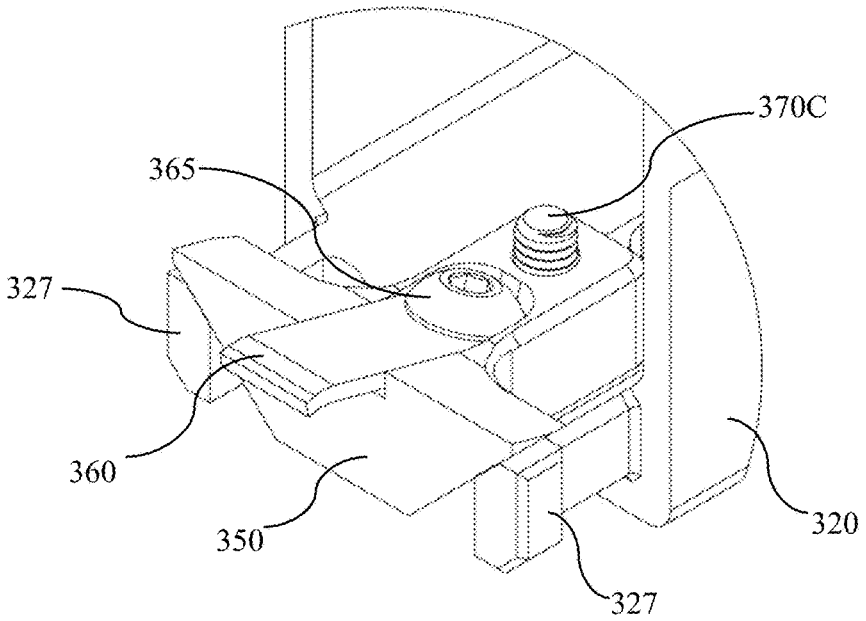
FIG. 10 is perspective view of an attachment assembly according to an embodiment.

The rear portion of the lower handguard 320 (i.e. the portion closest to the firearm's receiver) is attached to the firearm using the wedge block 350 and the leaf spring 360. FIG. 10 shows that the wedge block 350 fits between opposing extensions 327 of the lower handguard 320. As the wedge block 350 is drawn down relative to the lower handguard 320 with its attachment screw 370C, force is applied against the mating surfaces of two opposing extensions 327 of the lower handguard 320 deflecting them outwardly and into the sides and bottom of the receiver. Once this interaction occurs, the wedge block 350 pivots upward about this contact location driving the leaf spring 360 upward into the underside of the firearm's trunnion as the wedge block 350 is tightened into the lower handguard 320. The wedge block 350 makes contact with both an internal surface of the lower handguard 320 and the receiver with force in the vertical direction between that intersection and the contact point of the leaf spring 360 to the trunnion. Through the wedge block 350, this vertical force also provides opposing forces in outward directions of the extensions 327 against the internal sides of the receiver. This assembly and force mechanism firmly attaches the lower handguard 320 to the receiver with no modifications or fitting of the components or of the firearm.

Figure 20:
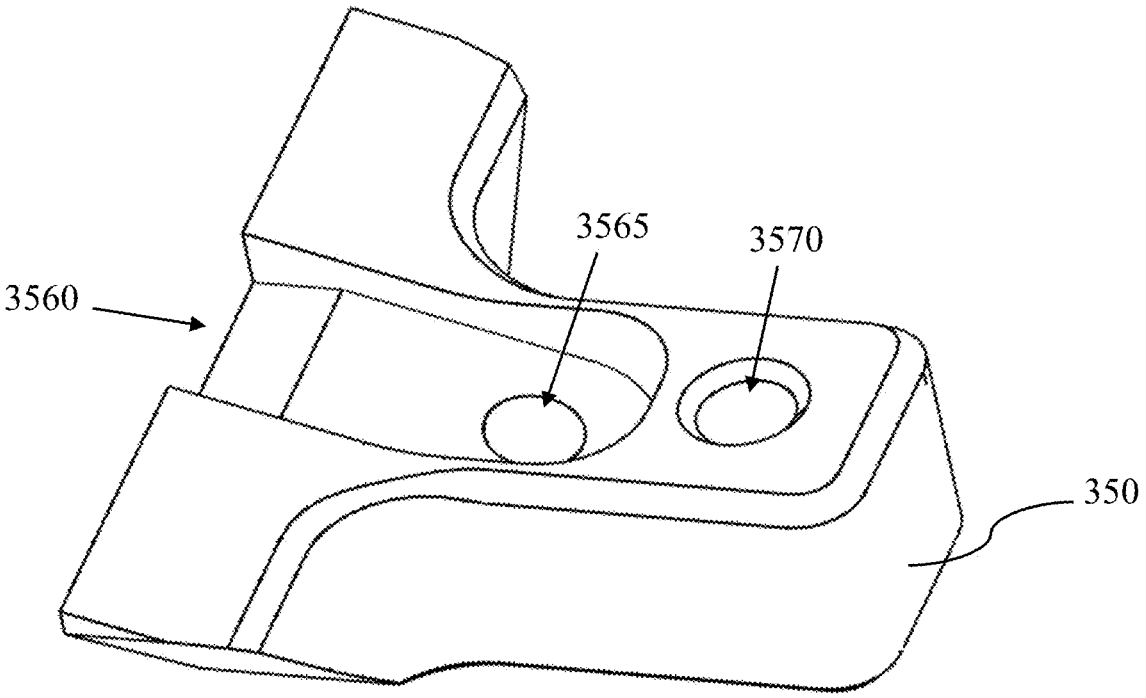
FIG. 20 and FIG. 21 are perspective views of a wedge block.
Figure 21:
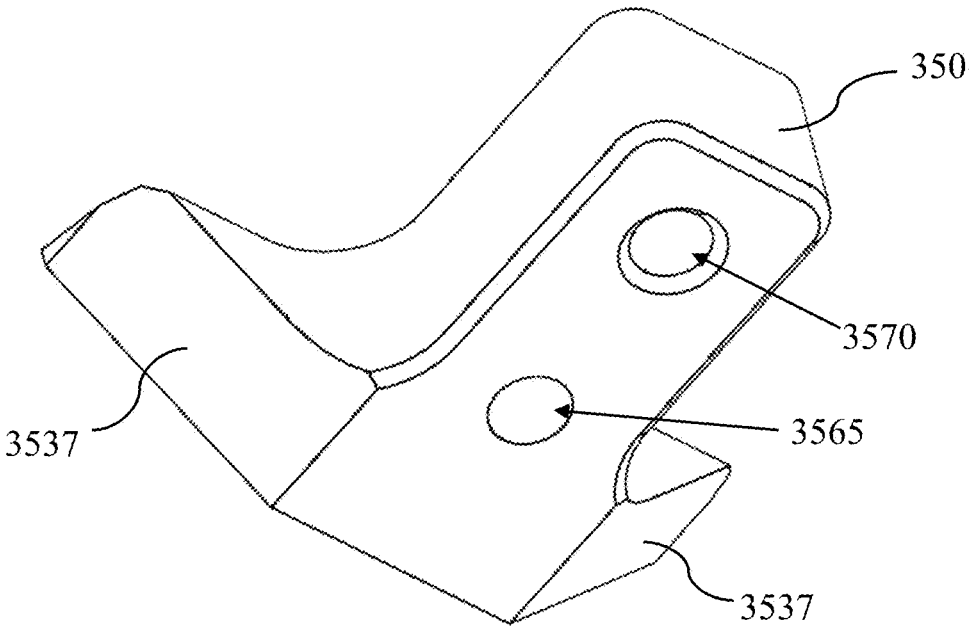

Top and bottom perspective views of the wedge block 350 are provided in FIGS. 20 and 21.

Figure 11:
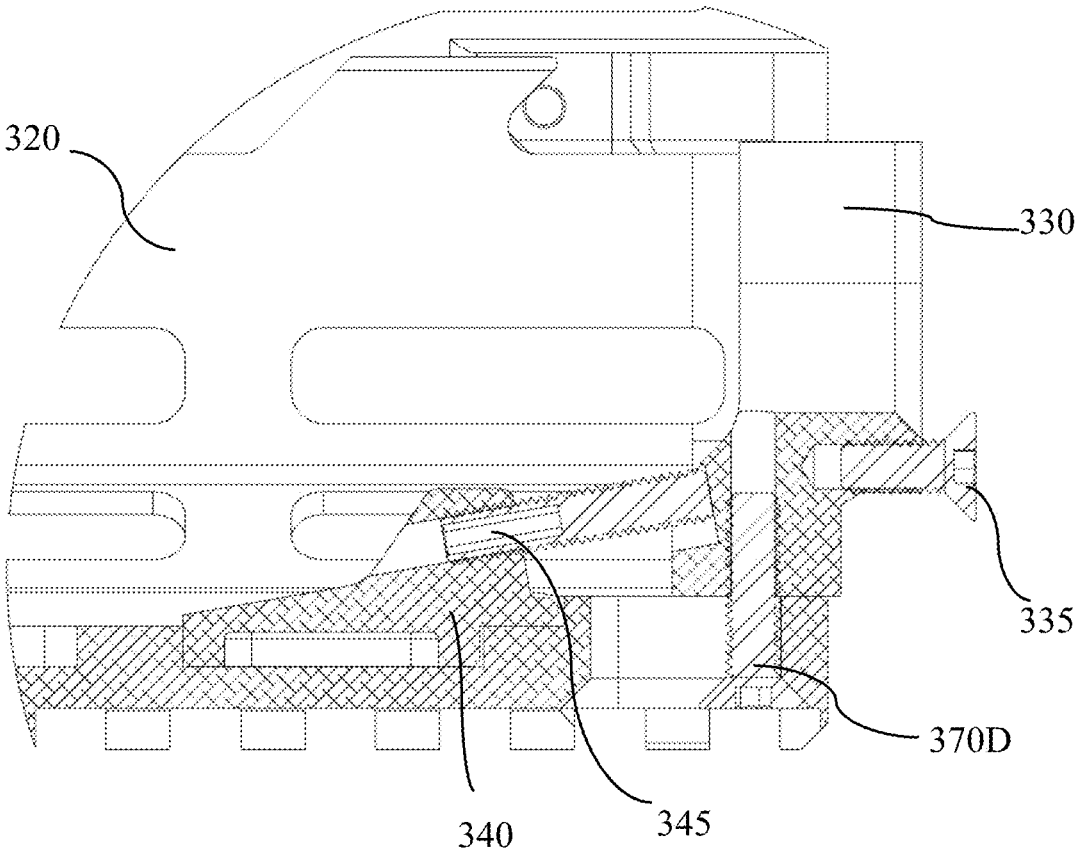
FIG. 11 is a cross sectional view of an attachment assembly according to an embodiment.

FIG. 11 is a cross section view of a portion of the front of the modular handguard assembly closest to the firearm's muzzle. The front of the lower handguard 320 is attached to the firearm using the U-mount 330. The U-mount 330 attaches to the base firearm's handguard retainer by repurposing an existing hole handguard retainer normally used for storing the firearm's cleaning rod by using the retaining screw 335. The U-mount's 330 geometry and profile provides adjustability to accommodate different existing AK handguard retainers. The lower handguard 320 is fastened to the U-mount 330 and, in turn, to the handguard retainer for stability. The lower handguard 320 includes a slot through which attachment screw 370D passes through to the U-mount 330. The slot provides adjustment freedom for proper fit to accommodate any variances in location of the based firearm components.

The retention mount 340 fits into a recessed groove in the lower handguard 320. The locking screw 345 is threaded through the retention mount 340 to a corresponding pocket in the U-mount 330 and is used to apply an opposing force from the U-mount 330 that in turn drives the retention mount 340 and the lower handguard 320 rearward against the front face of the receiver. This attachment assembly and force mechanism completes the positional control of the lower handguard 320 onto the base firearm.

Because the U-mount 330 is not in direct physical contact with the barrel or gas tube, the conductive path for heat generated by firing the firearm must come through the steel AK handguard retainer into the U-mount 330 and then into the modular handguard system 300. This lengthens the heat existing pathway and increases the time it takes the modular handguard system 300 to heat up from firing the firearm.

Figure 23:
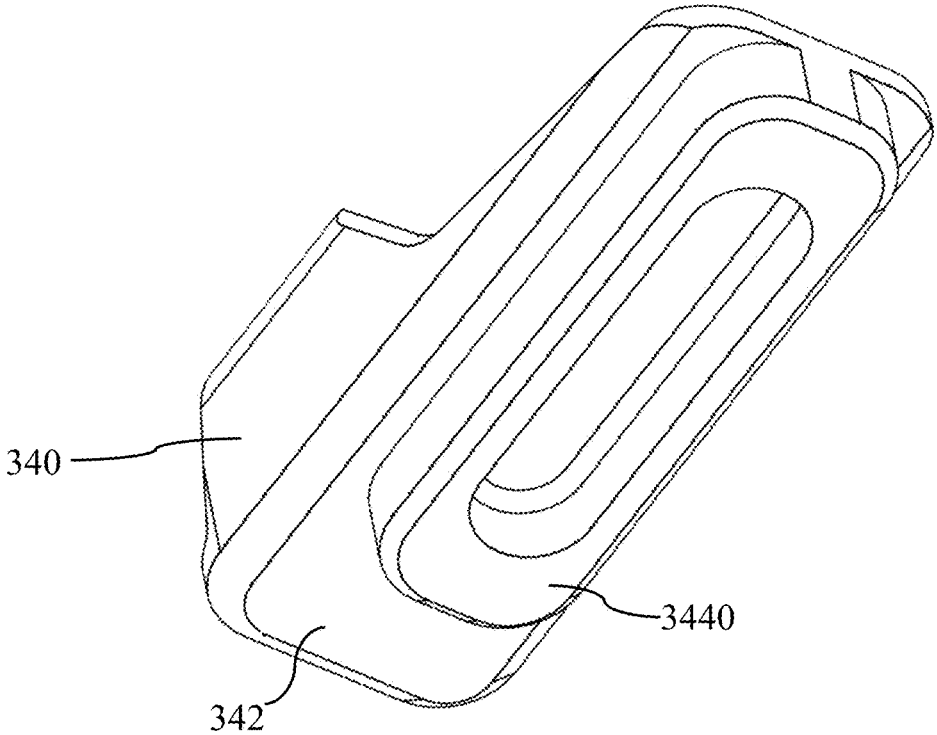
Figure 24:
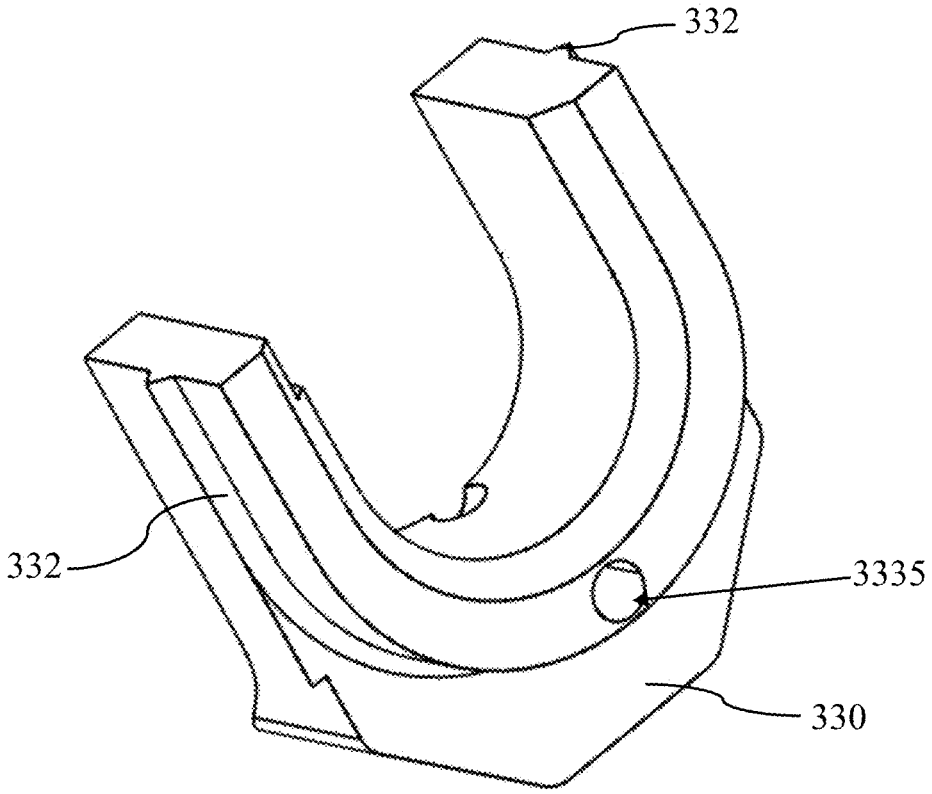
FIG. 24 and FIG. 25 are perspective views of a U-mount.
Figure 25:
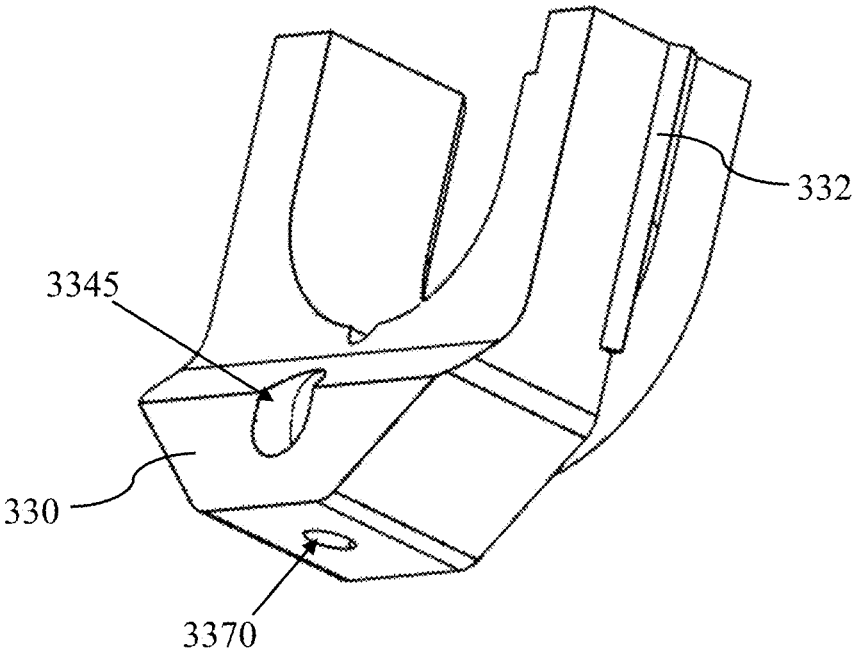

Perspective views of the U-mount 330 are provided in FIGS. 24 and 25. Perspective views of the retention mount 340 are provided in FIGS. 22 and 23.

No permanent modification of the base firearm is required to install the modular handguard system 300. Also, the components of the modular handguard system embodiments do not need to be modified to fit the base firearm. The original gas tube from the AK-type firearm can be reinstalled once the original upper handguard is removed. The gas tube can be accessed for maintenance or cleaning by removing the two attachment screws 370A and 370B and the upper handguard 310. The original AK sling mount is still accessible and does not interfere with any of the modular handguard system components. All components of the modular handguard system can be removed and the firearm can be returned to its original configuration by reinstalling its original components.

Components of embodiments of the disclosed modular handguard system can be made from any suitable material or combination of materials including metal, an alloy, ceramic, plastic, and composite. The materials can be defined by any suitable process or combination of processes including extrusion, stamping, casting, molding, machining, and 3D printing. The components can be finished using any suitable process and materials or combination of processes and materials including chemical conversion coating, anodizing, powder coating, plating, and painting.

FIGS. 12 to 15, 26, and 27 are perspective views of configurations of upper handguards, according to some embodiments. FIGS. 16 to 19 are perspective views of configurations of lower handguards, according to some embodiments. FIGS. 12 to 19 indicate the design flexibility of the disclosed modular handguard system and show various lengths of the upper and lower handguards both ending at the receiver at the rear end and the handguard retainer at the front end and extending beyond. Some embodiments are shown and other designs configured differently or including other features are possible while maintaining the same mounting assemblies and mechanisms and benefits described herein.

The length of the modular handguard system can extend past the existing front sight of the base firearm with the addition of a clearance in the top rail and any extension further to the rear for more optics mounting capabilities. The upper handguard attachment mechanism in the present disclosure allows multiple other upper handguards to be reconfigured and interchangeable. The length of the upper handguard and additional optics mounting provisions are considered. Embodiments of the upper handguard allow the base firearm's rear sight to remain intact and functional. The disclosed embodiments no way impact the use or adjustment of the existing sights. Additionally, the upper handguard provides a clearance channel to allow the front and rear sights to remain visible, serviceable, and functional.

Figure 12:
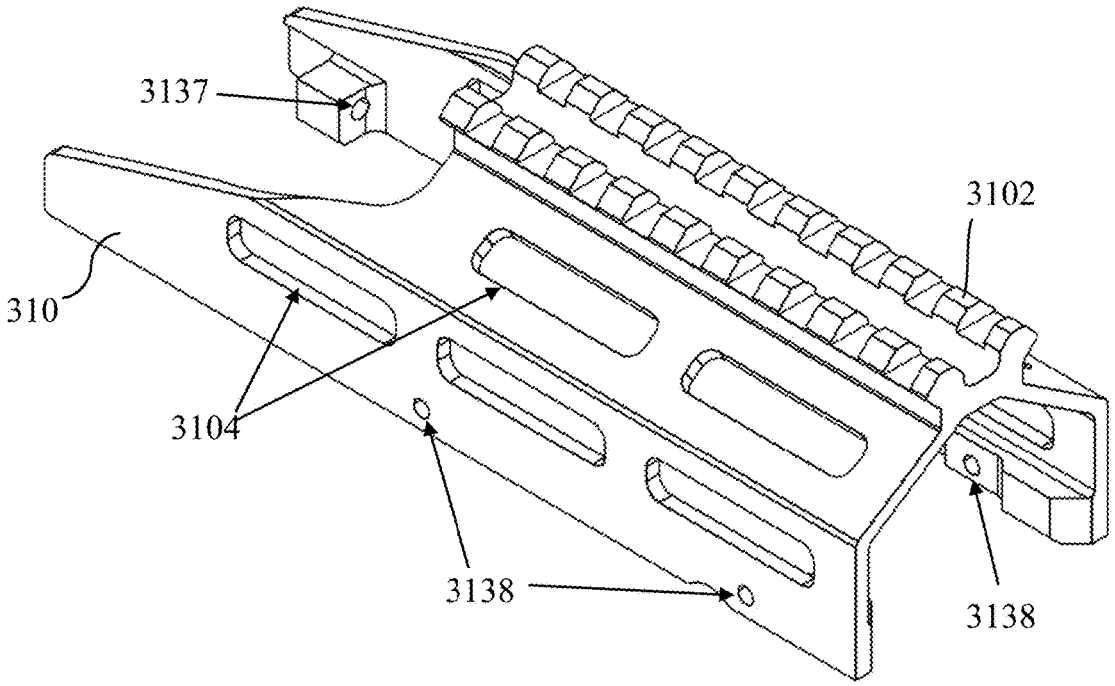
FIG. 12 and FIG. 13 are perspective views of an upper handguard according to an embodiment.
Figure 13:
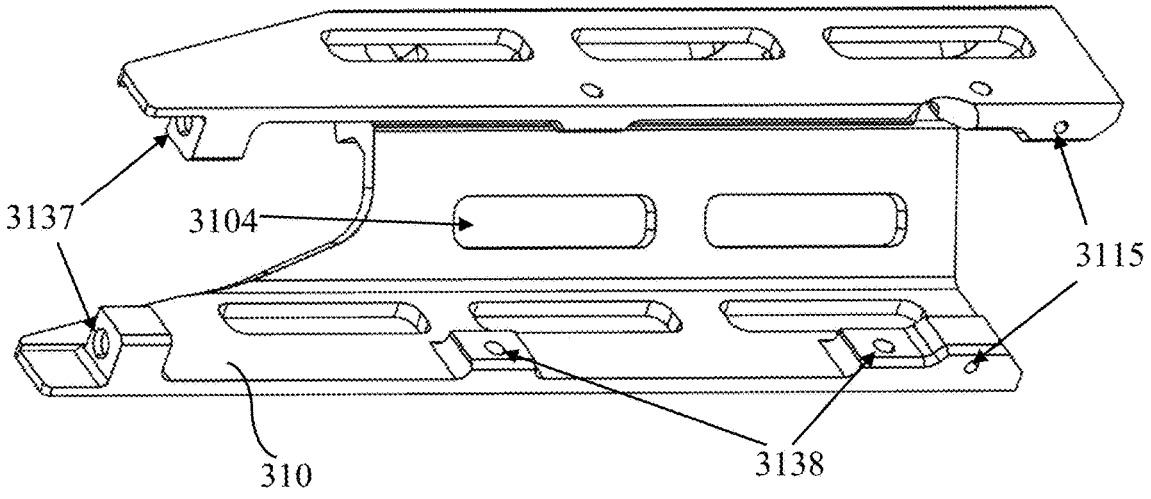

FIGS. 12 and 13 are perspective views of the upper handguard 310 used to previously describe the modular handguard system 300. This is a shorter version. As shown, the upper handguard 310 is generally inverted U-shaped and can include several slots or openings 3104 through the body as M-LOK® interfaces and to reduce weight and allow airflow while maintaining structural integrity. The upper handguard 310 can include a rail 3102 extending along the upper surface used to mount accessories. The upper surface can be cutout where the rail 3102 stops for clearance of the conventional rear iron sight on the base firearm. The upper handguard 310 can include mounting holes 3138 to accept the pins 380 and threaded mounting holes 3137 to accept the attachment screws 370A and 370B as shown in FIG. 3. FIG. 13 also shows holes 3115 that can be included for locating the limit pins 315 shown in FIG. 9.

Figure 14:
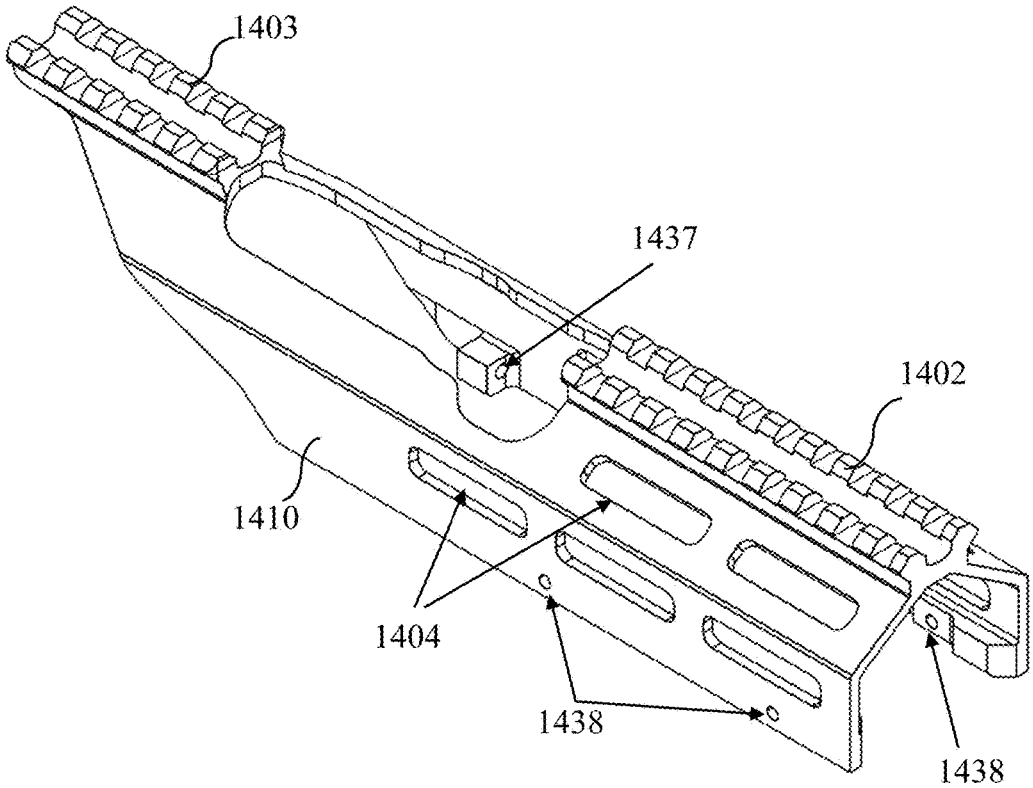
FIG. 14 and FIG. 15 are perspective views of an upper handguard according to an embodiment.
Figure 15:
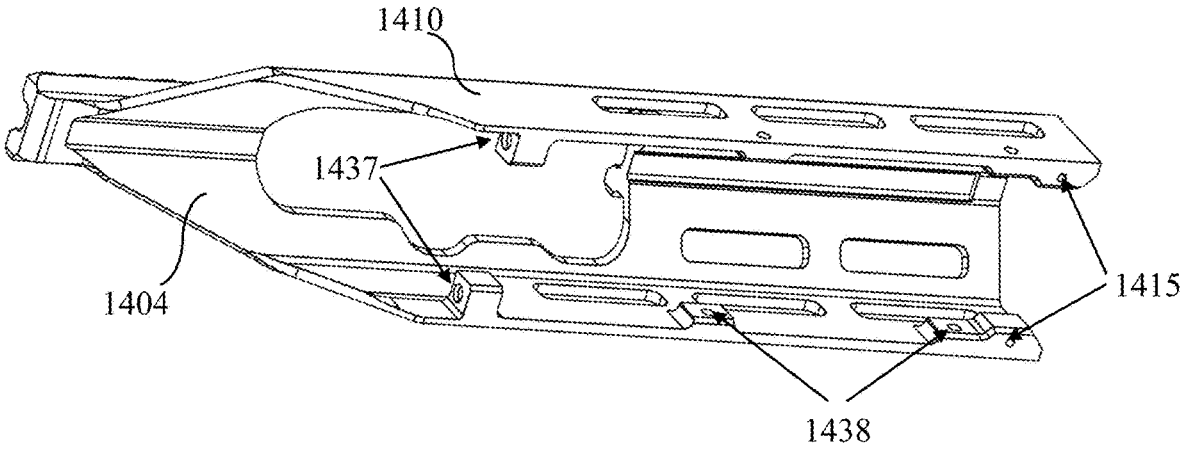

FIGS. 14 and 15 are perspective views of a longer version of an upper handguard 1410 according to an embodiment. As shown, the upper handguard 1410 is generally inverted U-shaped and can include several slots, openings, or M-LOK® interfaces 1404 through the body. The upper handguard 1410 can include a first rail 1402 and a second rail 1403 extending along the upper surface used to mount accessories. The upper surface can be cutout between the first rail 1402 and the second rail 1403 for clearance of the rear sight on the base firearm. The upper handguard 1410 can also include mounting holes 1438 to accept the pins 380 and threaded mounting holes 1437 to accept the attachment screws 370A and 370B as shown in FIG. 3. FIG. 15 also shows that holes 1415 can be included for locating the limit pins 315 shown in FIG. 9.

Figure 16:
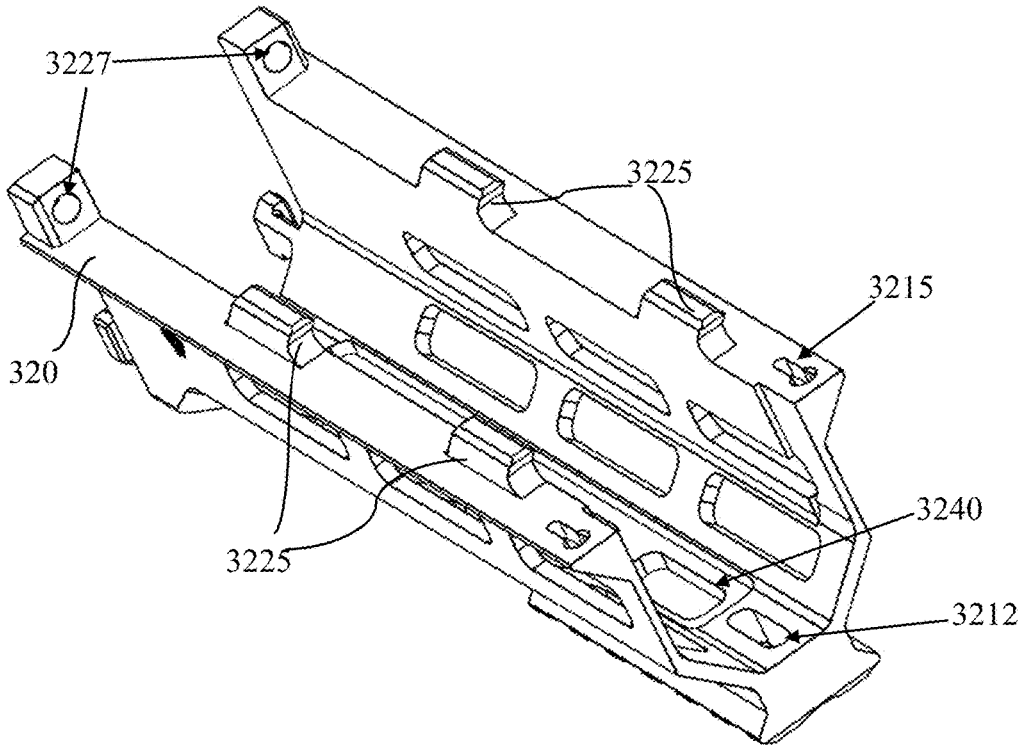
FIG. 16 and FIG. 17 are perspective views of a lower handguard according to an embodiment.
Figure 17:
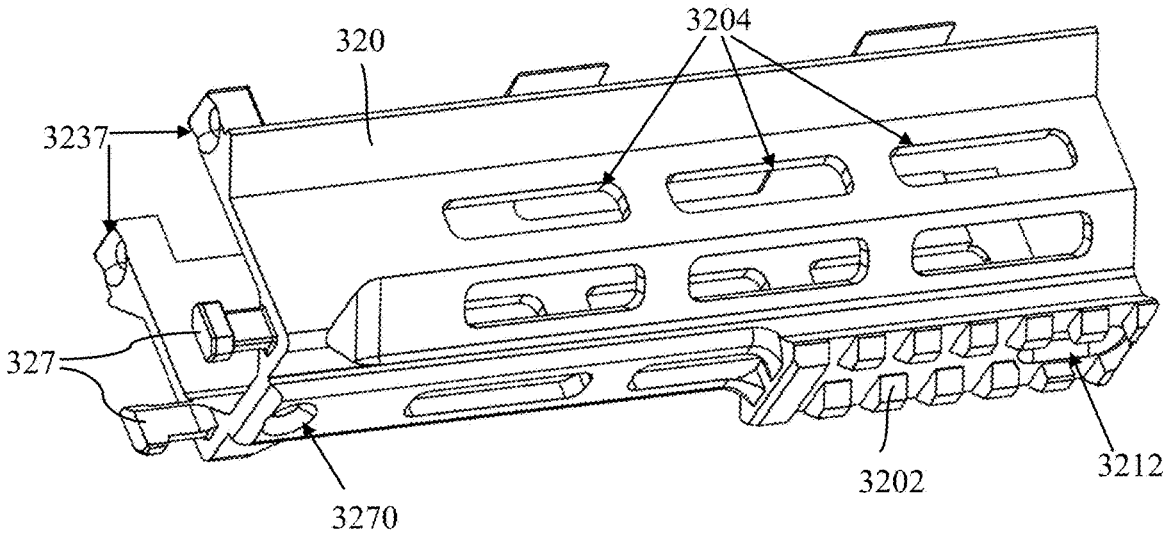

FIGS. 16 and 17 are perspective views of the lower handguard 320 used to previously describe the modular handguard system 300. This is a shorter version. As shown, the lower handguard 320 is generally U-shaped and can include several slots, openings, or M-LOK® interfaces 3204 through the body to reduce weight and allow airflow while maintaining structural integrity. The lower handguard 320 can include a rail 3202 extending along the lower surface used to mount accessories. As previously described, the lower handguard 320 can also include wedges 325 to accept the pins 380, threaded mounting holes 3237 to accept the attachment screws 370A and 370B as shown in FIG. 3, a through hole 3270 to accept the attachment screw 370C to retain the wedge block 350 and force outward the two extensions 327, slots 3215 to accept the limit pins 315 shown in FIG. 9, a slot 3212 to accept the attachment screw 370D to retain the U-mount 330, and a groove 3240 to accept the retention mount 340.

Figure 18:
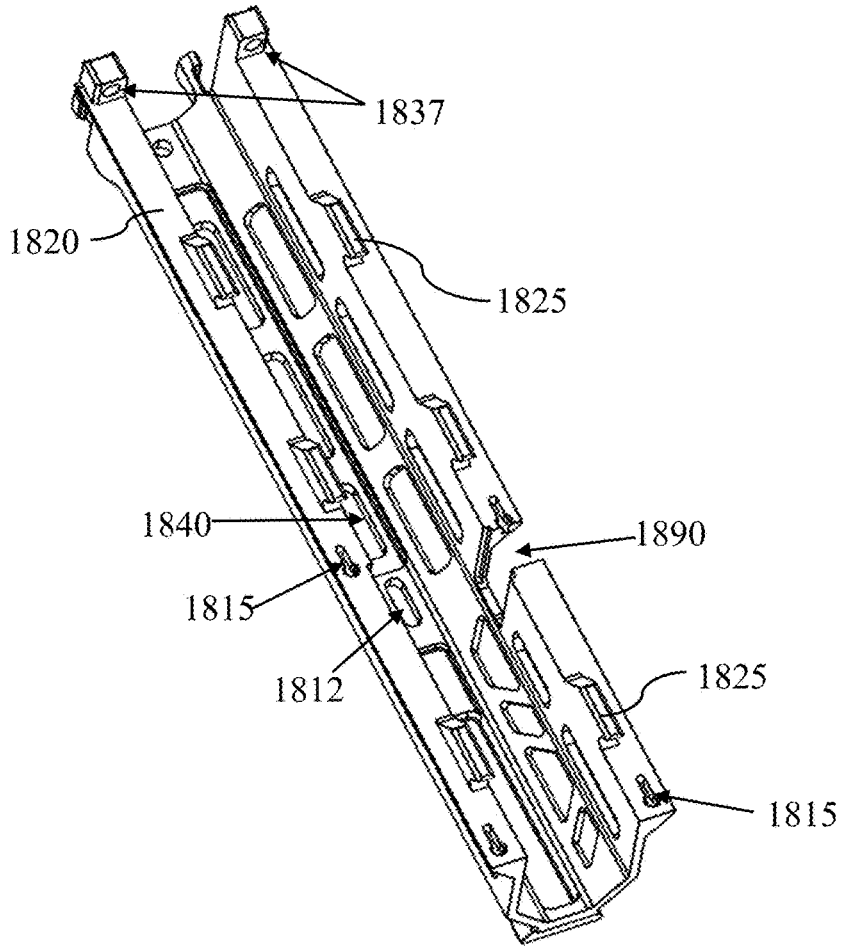
FIG. 18 and FIG. 19 are perspective views of a lower handguard according to an embodiment.
Figure 19:
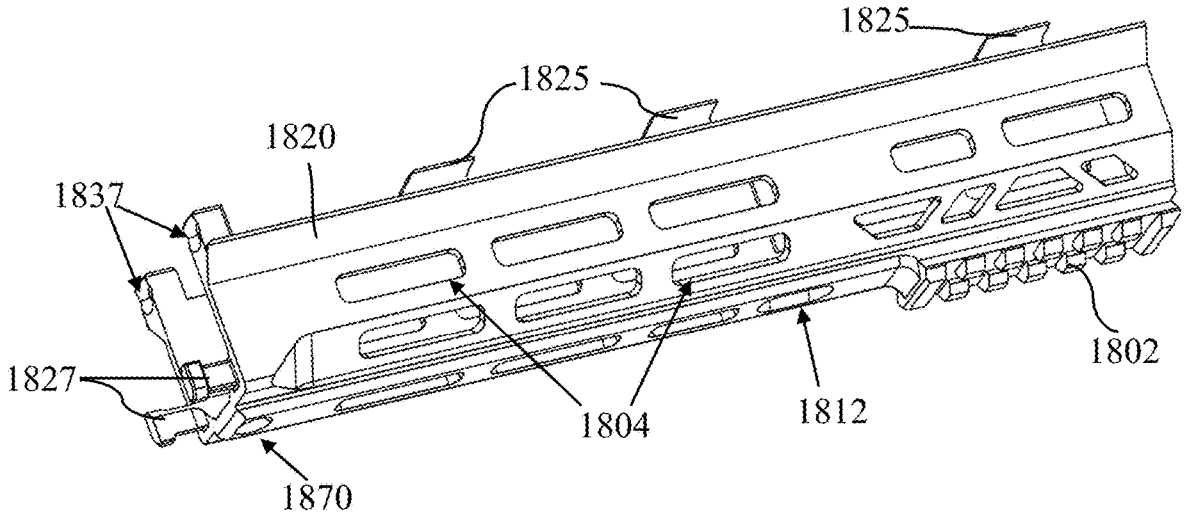

FIGS. 18 and 19 are perspective views of a longer version of a lower handguard 1820 according to an embodiment. The geometry of this lower handguard 1820 can be configured to mate with a longer or extended upper handguard to provide a longer handguard system with rails and other features that extend forward of the U-mount. As shown, the lower handguard 1820 is generally U-shaped and can include several slots, openings, or M-LOK® interfaces 1804. The lower handguard 1820 can include a rail 1802 extending along the lower surface used to mount accessories. The rail 1802 of this lower handguard extends to be more forward than the rail 3202 of the lower handguard 320. As previously described, the lower handguard 1820 can also include wedges 1825 to accept the pins 380, threaded mounting holes 1837 to accept the attachment screws 370A and 370B as shown in FIG. 3, a through hole 1870 to accept the attachment screw 370C to retain the wedge block 350 and force outward the two extensions 1827, slots 1815 to accept the limit pins 315 shown in FIG. 9, a slot 1812 to accept the attachment screw 370D to retain the U-mount 330, and a groove 1840 to accept the retention mount 340.

Figure 26:
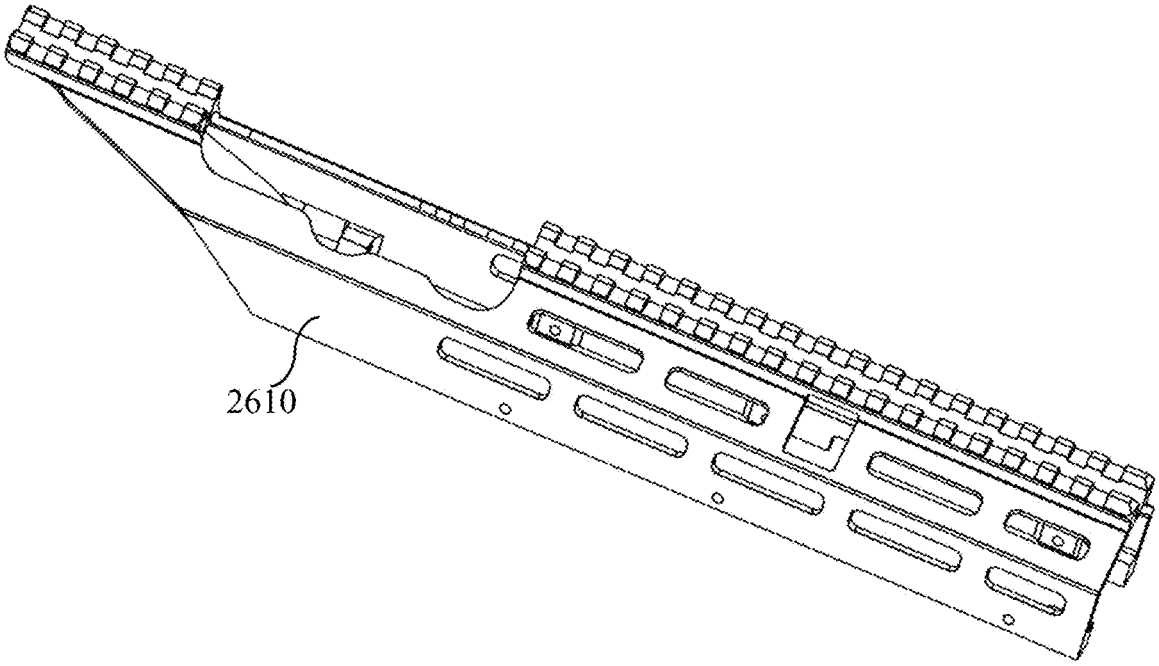
FIG. 26 and FIG. 27 are perspective views of an upper handguard according to an embodiment.
Figure 27:
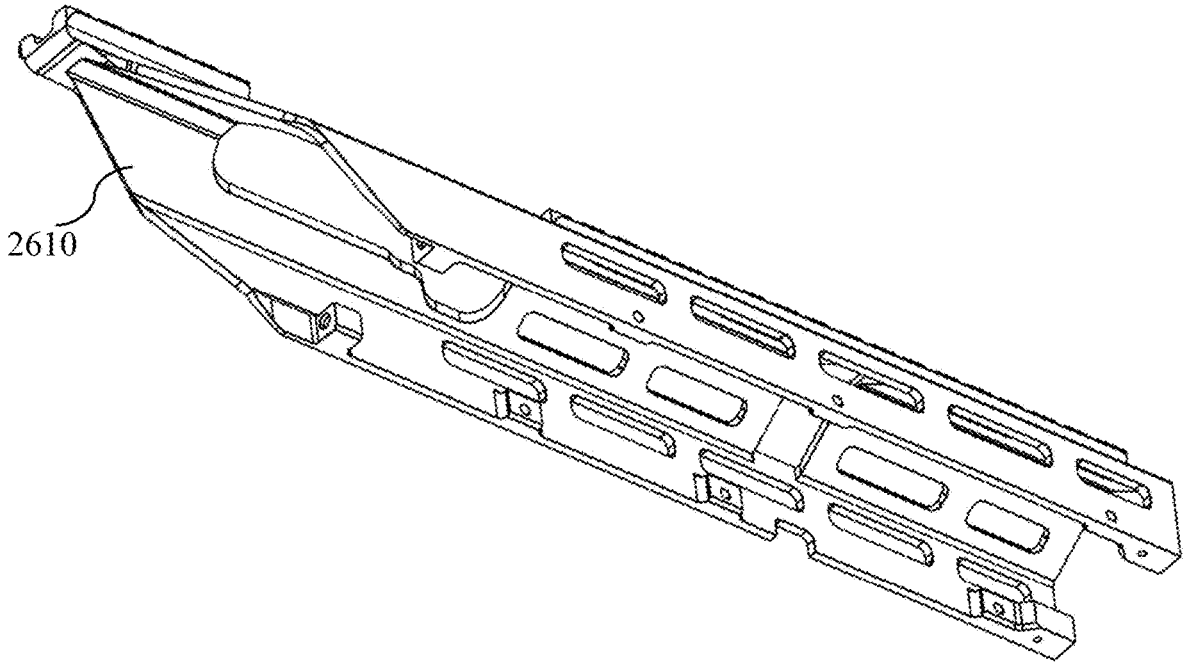

Because of the extended length of this lower handguard 1820, it is possible to include more wedges 1825 and slots 1815 than included on a shorter lower handguard to mate with corresponding features on an extended upper handguard, for example like the upper handguard 2610 shown in FIGS. 26 and 27, to provide increased stability in the longer modular handguard system. In addition, the lower handguard 1820 can include a cutout 1890 in one of the sides to provide clearance for an integrated sling loop in the base firearm's handguard retainer.

FIGS. 26 and 27 are different perspective views of an upper handguard 2610. Although, the upper handguard 2610 has a different geometric configuration than other upper handguards previously described, it is understood that many of the features are similar and their descriptions are omitted for brevity.

FIGS. 20 and 21 are different perspective views of the wedge block 350. As shown, the wedge block 350 can include a recess or groove 3560 in the top surface to accept the leaf spring, a threaded hole 3565 to accept the leaf spring screw 365, and a threaded hole 3570 to accept the attachment screw 370C. As previously described, the wedge block 350 can also include opposing inclined surfaces 3527 used to provide an outward force on extensions of a lower handguard while being drawn into the lower handguard.

Figure 22:
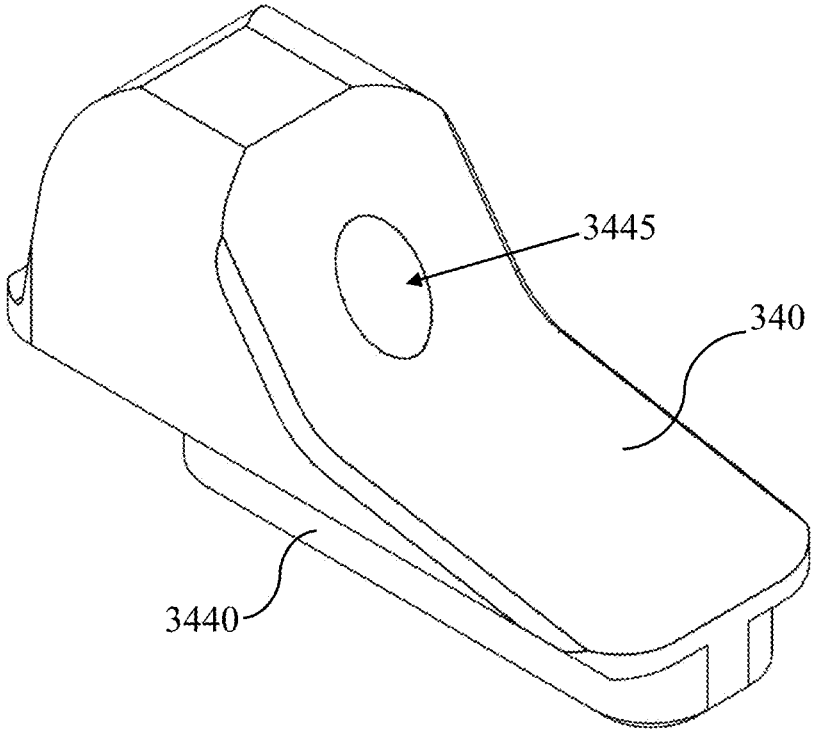
FIG. 22 and FIG. 23 are perspective views of a retention mount.

FIGS. 22 and 23 are different perspective views of the retention mount 340. As shown, the retention mount 340 can include a threaded hole 3445 to accept the locking screw 345. The retention mount 340 can also include a protrusion 3440 protruding from a bottom surface 342 that is configured to fit into a groove in a lower handguard. FIG. 23 shows that the protrusion 3440 can be oval shaped to fit into a corresponding oval shaped groove, although any suitable shape is possible.

FIGS. 24 and 25 are different perspective views of the U-mount 330. As shown, the U-mount 330 is generally U-shaped and configured to fit within and mate with a lower handguard. The U-mount 330 can include a threaded hole 3370 to accept the attachment screw 370D, a threaded hole 3335 to accept the retaining screw 335, and a pocket 3345 to accept the locking screw 345. The U-mount 330 can also include a protrusion or flange 332 extending along the sides to help to secure and lock in the U-mount to a lower handguard.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A handguard system for a firearm comprising:

a lower handguard attached to the firearm by a first mount providing an extension force between the lower handguard and a receiver of the firearm; and an upper handguard attached to the lower handguard, wherein the lower handguard includes two extensions configured to oppose each other and extend into the receiver, a wedge block of the first mount is configured to provide the extension force that forces the two extensions into opposing internal surfaces of the receiver as the wedge block and the lower handguard are forced together, and the extension force attaches the lower handguard to the receiver.

2. The handguard system according to claim 1, further comprising a second mount configured to provide a rearward force to the lower handguard between a handguard retainer of the firearm and the receiver.

3. The handguard system according to claim 2, wherein the first mount, the second mount, the upper handguard, and the lower handguard are not in direct physical contact to a barrel or a gas tube of the firearm.

4. The handguard system according to claim 2, further comprising a retention mount configured to fit in a groove of the lower handguard, wherein the second mount includes a U-mount configured to fit with the lower handguard and to attach to the handguard retainer of the firearm and provide the rearward force of the lower handguard between the handguard retainer and the receiver via the retention mount.

5. The handguard system according to claim 1, wherein the lower handguard and the upper handguard include a rail.

6. The handguard system according to claim 1, wherein the upper handguard is configured to extend rearward of and not interfere with a rear sight of the firearm.

7. The handguard system according to claim 1, wherein an aiming device attached to the upper handguard is returned to zero within 1.5 MOA when the upper handguard is removed from the lower handguard and reinstalled to the lower handguard.

8. A firearm including the handguard system of claim 1.

9. The handguard system according to claim 1, further comprising a spring attached to the wedge block and configured such that the spring provides a spring force to a trunnion of the firearm as the wedge block and the lower handguard are forced together.

10. The handguard system according to claim 1, wherein the extension is two opposing extensions that are configured to fit inside the receiver and the extension force forces the two opposing extensions into opposing internal surfaces of the receiver.

11. The handguard system according to claim 1, further comprising a retention mount configured to fit in a groove of the lower handguard; and a locking screw threaded through the retention mount to a corresponding pocket in a U-mount that applies an opposing force from the U-mount that in turn drives the retention mount and the lower handguard rearward against a front surface of the receiver of the firearm.

12. A handguard system for a firearm comprising:

a lower handguard attached to the firearm by a first mount providing an extension force between the lower handguard and a receiver of the firearm; and an upper handguard attached to the lower handguard, wherein the first mount includes a wedge block and a spring attached to the wedge block and configured such that the spring provides a spring force to a trunnion of the firearm as the wedge block and the lower handguard are forced together.

* * * * *